US005960824A

United States Patent [19]

Sullivan

[11] Patent Number: 5,960,824

[45] Date of Patent: Oct. 5, 1999

[54] SCROLL COMPRESSOR HAVING CONTOURED FIXED ROTATION SUCTION CONTROL VALVE

[75] Inventor: Timothy James Sullivan, Dublin, Ohio

[73] Assignee: Ford Motor Company, Dearborn, Mich.

[21] Appl. No.: 09/088,418

[22] Filed: Jun. 1, 1998

[51] Int. Cl.[6] ..... F16K 15/00; F04B 49/00

[52] U.S. Cl. ..... 137/517; 417/307

[58] Field of Search ..... 137/517, 538, 137/540; 417/440, 307

[56] References Cited

U.S. PATENT DOCUMENTS

| | | | |
|---|---|---|---|
| 1,728,677 | 9/1929 | George | 137/517 |
| 3,814,134 | 6/1974 | Vanti | 137/517 |
| 4,249,566 | 2/1981 | Deane | 137/517 |
| 4,474,356 | 10/1984 | Baumann | 251/122 |
| 4,474,756 | 10/1984 | Sato et al. | 417/307 |
| 4,496,296 | 1/1985 | Arai et al. | 417/440 |
| 4,497,615 | 2/1985 | Griffith | 417/440 |
| 4,505,651 | 3/1985 | Terauchi et al. | 417/440 |
| 4,514,150 | 4/1985 | Hiraga et al. | 417/440 |
| 4,642,034 | 2/1987 | Terauchi | 417/295 |
| 4,717,314 | 1/1988 | Sato et al. | 417/310 |
| 4,813,452 | 3/1989 | Smith | 137/542 |
| 4,890,987 | 1/1990 | Sato et al. | 417/310 |
| 5,347,812 | 9/1994 | Nilsson et al. | 137/538 |
| 5,427,358 | 6/1995 | Eggleston et al. | 251/367 |
| 5,630,225 | 5/1997 | Matsuda et al. | 417/299 |

*Primary Examiner*—Denise L. Ferensic
*Assistant Examiner*—Joanne Y. Kim
*Attorney, Agent, or Firm*—Roger L. May; James J. Dottavio

[57] ABSTRACT

A suction control valve for a scroll compressor has a valve piston with a contoured surface for encouraging aerodynamic flow through the valve. The contoured surface is not symmetrical about a vertical axis. Slots are provided in the housing and piston for engaging the valve spring to prevent rotation of the piston so that the nonsymmetry of the contoured piston surface does not affect fluid flow during operation.

10 Claims, 1 Drawing Sheet

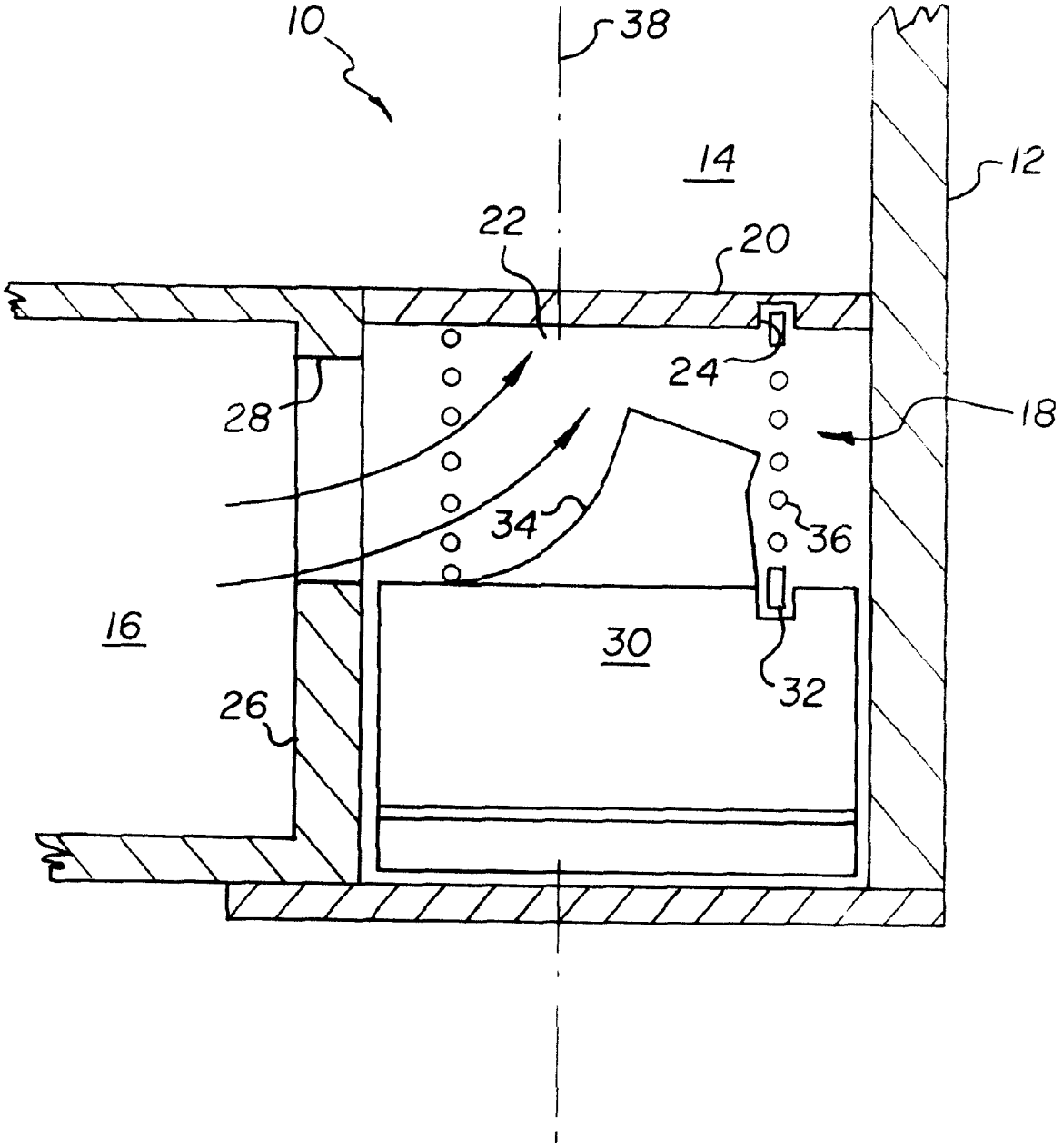
10
38
14
12
22
20
24
28
18
34
36
16
30
32
26

SCROLL COMPRESSOR HAVING CONTOURED FIXED ROTATION SUCTION CONTROL VALVE

FIELD OF THE INVENTION

The present invention relates generally to compressors, and, more particularly, to a suction control valve for a scroll compressor.

BACKGROUND OF THE INVENTION

A suction control valve is used in a scroll compressor to control fluid flow between an intermediate chamber and a suction chamber to regulate compressor operation. The valve has a piston that slides in a cylinder with a sidewall opening providing a fluid passageway from the intermediate chamber into the cylinder. A top cylinder wall opening provides a fluid passageway from the cylinder to the suction chamber. As the piston slides, the size of the sidewall opening changes to regulate the volume of fluid. Changing the size or shape of the opening while fluid is flowing creates turbulence in the flow which interferes with precise regulation of the compressor.

The piston is biased by a coil spring seated against the piston. The piston normally has a stepped surface with sharp corners to retain the spring on the piston. Fluid flowing through the cylinder travels over the stepped surface and suffers from this stepped non-aerodynamic shape and realizes higher flow losses. High flow loss is undesirable because it makes compressor regulation more difficult.

A considerable fraction of flow occurs through the cylinder port and interacts with the suction control valve. Experimentation and physics do prove that this flow interaction with the suction control valve is critical to compressor operation. It is therefore desirable to make the interaction surface of the suction control valve aerodynamic in nature.

SUMMARY OF THE INVENTION

The present invention is directed to overcoming one or more of the problems set forth above. Briefly summarized, according to one aspect of the present invention, a suction control valve for scroll compressor comprises a housing, valve piston and valve spring. The housing defines a cylinder that has a top wall containing a spring slot and a suction chamber opening for fluid communication between the cylinder and a suction chamber. The cylinder also has a sidewall containing an intermediate chamber opening for fluid communication between the cylinder and an intermediate chamber. The valve piston has a top portion containing a spring slot and is slidably disposed in the cylinder to control the size of the intermediate chamber opening.

Mounting the valve spring on the valve piston between the top surface of the piston and top wall biases the piston for maximum fluid flow through the cylinder. Seating the valve spring in the piston and top wall spring slots prevents rotation of the piston so that orientation of the piston surfaces relative to the chamber openings does not change. Fixed orientation allows a nonsymmertical surface configuration to be used that promotes efficient fluid flow through the cylinder for more precise regulation of the compressor.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWING

The drawing is a diagrammatic sectional view of a scroll compressor containing a suction control valve according to the present invention.

DETAILED DESCRIPTION OF THE PREFERRED EMBODIMENTS

Referring to the drawing, a variable scroll compressor 10 has a housing 12 containing a suction chamber 14 and an intermediate chamber 16. A control valve 18 controls fluid flow between the chambers 14, 16 to regulate the capacity of the compressor 10. The housing 12 defines a cylinder which has a top wall 20 containing a suction chamber opening 22 and a spring slot 24, and which has a sidewall 26 containing an intermediate chamber opening 28. The two openings allow fluid flow between the suction chamber 14 and intermediate chamber 16. The large volume suction chamber acts as a tank for suction fluid.

A valve piston 30 is slidably disposed in the cylinder. It has a top portion containing a spring slot 32 and a surface 34. The spring slots 24, 32 locate and anchor a valve spring 36 between the piston surface 34 and top wall 20 of the cylinder. The piston is movable along a vertical axis 38 between and open position and a closed position. At the open position the valve piston is disposed toward a bottom of the cylinder allowing maximum fluid flow in through the intermediate chamber opening and out through suction chamber opening. At the closed position the piston is disposed toward a top of the cylinder allowing minimum fluid flow in through the intermediate chamber opening and out through the suction chamber opening. The reciprocating movement of the piston thus controls the size of the openings to thereby control fluid flow through the cylinder for regulating the compressor. When fully uncovered the chamber opening allows a high volume of high velocity refrigerant fluid to pass through it.

Valve spring 36 is preferably a coil spring that is mounted on the valve piston and seated in the piston and top wall spring slots. It opposes the suction force from the suction chamber tending to close the valve by biasing the valve toward the open position which position allows maximum fluid flow through the cylinder.

The surface of the valve piston is a contoured surface for directing fluid through the cylinder. The contoured surface is derived using computational fluid dynamics to generate a CAD (computer aided design) description of the contour desired. A commercial computer program named STAR-CD distributed by Adapco, 60 Broadhollow Road, Melville, N.Y. 11747 can be used for fluid flow simulations. In the preferred embodiment, the contoured surface is machined into the body of the suction control valve and looks very much like the concave portion of a duct elbow. The valve is preferably constructed of brass which its easily machined to obtain the contoured surface. The contoured surface directs fluid flowing from the intermediate chamber opening through the cylinder to the suction chamber opening in a highly aerodynamic manner. The valve spring cooperates with the contoured surface by engaging the spring slots to prevent rotation of the valve piston thereby maintaining the surface orientation to maintain efficient fluid flow.

It will be now appreciated that there has been presented a piston valve with a turbulence minimizing surface that does not require symmetry for more efficient and effective surface configuration. The coil spring locks the piston against rotation so that the contoured surface maintains its orientation relative to the fluid flow from the intermediate chamber.

While the invention has been described with particular reference to a preferred embodiment, it will be understood by those skilled in the art that various changes may be made and equivalents may be substituted for elements of the preferred embodiment without departing from invention.

For example, while the spring engaging members have been described as slots, holes or bores into the piston and top wall will anchor the spring as well. It is accordingly intended that the claims shall cover all such modifications and applications as do not depart from the true spirit and scope of the invention.

What is claimed is:

1. A scroll compressor, comprising:

a housing defining a suction chamber, an intermediate chamber and a cylinder, said cylinder having a sidewall containing an opening and a top wall containing an opening and a slot;

a valve piston having a top portion containing a slot and being slidably disposed in said cylinder, said piston being movable between and open position at which said piston is disposed toward a bottom of said cylinder allowing maximum fluid flow from said intermediate chamber through said sidewall opening to said cylinder and suction cavity, and a closed position at which said piston is disposed toward a top of said cylinder allowing minimum fluid flow from said intermediate chamber through said sidewall opening to said cylinder and suction chamber; and a valve spring mounted on said valve piston and seated in said piston and top wall slots.

2. A scroll compressor, as set forth in claim 1, wherein said valve piston has a vertical axis and slides in a path along said axis, and wherein said valve spring engages said slots to prevent rotation of said valve piston about said vertical axis.

3. A scroll compressor, as set forth in claim 1, wherein said top portion of said valve piston has a contoured surface for directing fluid flow through said cylinder.

4. A scroll compressor, as set forth in claim 1, wherein said top portion of said valve piston has a contoured surface for directing fluid flow from said intermediate chamber through said cylinder to said suction chamber in an aerodynamic manner.

5. A scroll compressor, as set forth in claim 1, wherein said top portion of said valve piston has a contoured surface for directing fluid flow from said intermediate chamber through said cylinder to said suction chamber in an aerodynamic manner and wherein said valve spring engages said piston and top wall slots to prevent rotation of said valve piston and maintain efficient fluid flow.

6. A suction control valve for scroll compressor, comprising:

a housing defining a cylinder having a top wall containing a suction chamber opening and a spring slot, and having a sidewall containing an intermediate chamber opening;

a valve piston having a top portion containing a spring slot and being slidably disposed in said cylinder, said piston being movable between and open position at which said piston is disposed toward a bottom of said cylinder allowing maximum fluid flow in through said intermediate chamber opening and out through suction chamber opening, and a closed position at which said piston is disposed toward a top of said cylinder allowing minimum fluid flow in through said intermediate chamber opening and out through said suction chamber opening; and a valve spring mounted on said valve piston and seated in said piston and top wall spring slots.

7. A suction control valve, as set forth in claim 6, wherein said valve piston has a vertical axis and slides in a path along said axis, and wherein said valve spring engages said spring slots to prevent rotation of said valve piston about said vertical axis.

8. A suction control valve, as set forth in claim 6, wherein said top portion of said valve piston has a contoured surface for directing fluid flow through said cylinder.

9. A suction control valve, as set forth in claim 6, wherein said top portion of said valve piston has a contoured surface for directing fluid flow from said intermediate chamber opening through said cylinder to said suction chamber opening in an aerodynamic manner.

10. A suction control valve, as set forth in claim 6, wherein said top portion of said valve piston has a contoured surface for directing fluid flow from said intermediate chamber opening through said cylinder to said suction chamber opening in an aerodynamic manner and wherein said valve spring engages said piston and top wall spring slots to prevent rotation of said valve piston and maintain efficient fluid flow.

* * * * *